US008953297B2

(12) United States Patent
Gavin

(10) Patent No.: US 8,953,297 B2
(45) Date of Patent: Feb. 10, 2015

(54) APPARATUS AND METHODS FOR A WIRE-TETHERED ELECTRODE FOR AN ELECTRONIC WEAPON

(71) Applicant: TASER International, Inc., Scottsdale, AZ (US)

(72) Inventor: William David Gavin, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

(21) Appl. No.: 14/042,526

(22) Filed: Sep. 30, 2013

(65) Prior Publication Data

US 2014/0233146 A1 Aug. 21, 2014

Related U.S. Application Data

(63) Continuation of application No. 12/797,546, filed on Jun. 9, 2010, now Pat. No. 8,547,679.

(60) Provisional application No. 61/186,643, filed on Jun. 12, 2009.

(51) Int. Cl.
*H01T 23/00* (2006.01)
*F41H 13/00* (2006.01)

(52) U.S. Cl.
CPC ..... *F41H 13/0025* (2013.01)
USPC ..... 361/232

(58) Field of Classification Search
USPC ..... 361/232
See application file for complete search history.

(56) References Cited

U.S. PATENT DOCUMENTS

| | | | | |
|---|---|---|---|---|
| 5,100,346 | A | 3/1992 | McCardell | |
| 5,698,815 | A | 12/1997 | Ragner | |
| 5,782,761 | A | 7/1998 | Gusakov | |
| 5,786,546 | A | 7/1998 | Simson | |
| 5,831,199 | A | 11/1998 | McNulty | |
| 6,461,357 | B1 | 10/2002 | Sharkey | |
| 7,100,514 | B2 | 9/2006 | LeBourgeois | |
| 7,434,517 | B1 | 10/2008 | Linker | |
| 7,600,337 | B2 | 10/2009 | Nerheim | |
| 7,984,676 | B1 | 7/2011 | Gavin | |
| 8,547,679 | B2 * | 10/2013 | Gavin | 361/232 |
| 2005/0033397 | A1 | 2/2005 | Aisenbrey | |
| 2010/0315755 | A1 | 12/2010 | Gavin | |

* cited by examiner

*Primary Examiner* — Stephen W Jackson
(74) *Attorney, Agent, or Firm* — William R. Bachand; Lawrence Letham

(57) ABSTRACT

An electronic weapon has an installed deployment unit from which an electrode is launched. The electrode is tethered to the deployment unit by a wire or filament. According to various aspects of the present invention, a wire-tethered electrode for launching from a weapon, for impacting clothing of a human target, and for conducting a stimulus signal through the target to inhibit locomotion by the target includes an insulated wire, a spear, and a body. The wire mechanically couples the electrode to the weapon. The spear lodges in the clothing. The body has an interior. The interior confines the wire against the spear so that the stimulus signal ionizes air in a gap between an uninsulated end of the wire and the spear, and ionizes air between the barb and tissue of the target to facilitate conducting the stimulus signal through the spear and through the target.

7 Claims, 14 Drawing Sheets

APPARATUS AND METHODS FOR A WIRE-TETHERED ELECTRODE FOR AN ELECTRONIC WEAPON

CROSS-REFERENCE TO RELATED APPLICATIONS

This application is a continuation application of and claims benefit under 35 U.S.C. §120 from U.S. patent application Ser. No. 12/797,546 to Gavin, filed Jun. 9, 2010, now U.S. Pat. No. 8,547,679, which claims the benefit under 35 U.S.C. §119(e) of U.S. provisional patent application 61/186,643 to Gavin, filed Jun. 12, 2009 incorporated herein by reference.

FIELD OF THE INVENTION

Embodiments of the present invention relate to electronic weaponry, deployment units, and electrodes used in deployment units for electronic weaponry, and to methods of manufacturing deployment units and electrodes.

BACKGROUND OF THE INVENTION

Conventional electronic weapons launch at least one, and generally two electrodes (e.g., darts, probes) toward a target to deliver a stimulus signal (e.g., current, pulses of current) through the target to inhibit locomotion by the target. A thin wire (e.g., filament) couples a signal generator in the electronic weapon to each electrode positioned in or near the target. The signal generator provides the stimulus signal through the target via the filament and the electrode(s). Electronic weapons may benefit from an electrode that costs less to manufacture, reduces manual labor required to assemble the electrode, reduces labor required to couple the electrode to the filament, and reduces damage to the filament during assembly.

A conventional electrode is assembled by inserting a sharpened shaft into an axial hole in a forward face of a cylindrical body, crimping the body to retain the shaft, threading a filament through a second axial hole in a rearward face of the body and into an open portion of the body, tying a knot in the filament, and pulling the knot into the open portion of the body.

BRIEF DESCRIPTION OF THE DRAWING

Embodiments of the present invention are described with reference to the drawing, wherein like designations denote like elements, and.

DETAILED DESCRIPTION OF THE PREFERRED EMBODIMENTS

Figure 1:
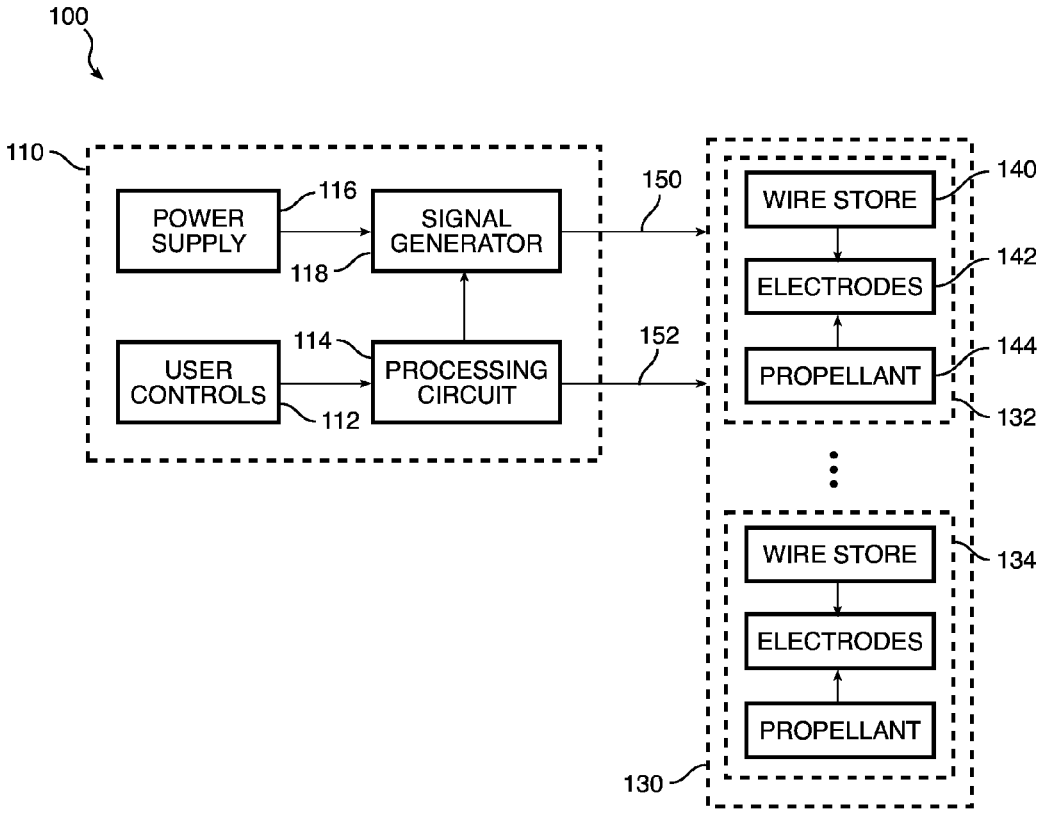
FIG. 1 is a functional block diagram of an electronic weapon according to various aspects of the present invention.

An electronic weapon, according to various aspects of the present invention, delivers a current through a human or animal target to interfere with locomotion by the target. An important class of electronic weapons launch at least one wire-tethered electrode, also called a dart or a probe, toward a target to position the electrode in or near target tissue. A respective filament (e g, thin wire whether insulated or uninsulated) extends from the electronic weapon to each electrode at the target. The electronic weapon provides a stimulus signal (e.g., current, pulses of current) through the filament, the electrode, and the target to interfere with locomotion by the target. Interference includes causing involuntary contraction of skeletal muscles to halt voluntary locomotion by the target and/or causing pain to the target to motivate the target to voluntarily stop moving.

An electronic weapon may include a launch device and one or more field replaceable deployment units. Each deployment unit may include expendable (e.g., single use) components (e.g., tether wires, electrodes, propellant, cartridge housing). Herein, the tether is interchangeably called a wire, a tether wire, and a filament. A wire-tethered electrode is an assembly of a filament and an electrode. In the assembly, the electrode is at least mechanically coupled to one end of the filament. The other end of the filament is at least mechanically coupled to the deployment unit and/or the launch device (e.g., one end fixed within the deployment unit), generally until the deployment unit is removed from the electronic weapon. As discussed below, mechanical coupling may further include electrical coupling of the filament and electrode prior to and/or during operation of the electronic weapon.

A launch device of an electronic weapon launches a wire-tethered electrode of the electronic weapon toward a target. As the electrode travels toward the target, the electrode pulls a length of filament from a wire store. The filament trails the electrode. After launch, the filament stretches (e.g., spans, extends, bridges) from an electrode positioned in or near a target to the launch device.

Electronic weapons that use wire-tethered electrodes, according to various aspects of the present invention, include handheld devices, apparatus fixed to buildings or vehicles, and stand-alone stations. Hand-held devices may be used in law enforcement, for example, deployed by an officer to take custody of a target. Apparatus fixed to buildings or vehicles may be used at security checkpoints or borders, for example, to manually or automatically acquire, track, and/or deploy electrodes to stop intruders. Stand-alone stations may be set up for area denial, for example, as used by military operations. Conventional electronic weapons such as the model X26 electronic control device, and Shockwave™ area denial unit marketed by TASER International, Inc. may be modified to implement the teachings of the present invention by replacing the conventional deployment units with deployment units having electrodes as discussed herein.

An electrode provides a mass for launching toward a target. The intrinsic mass of an electrode includes a mass that is sufficient to fly, under force of a propellant, from a launch device to a target. The mass of the electrode includes a mass that is sufficient to draw (e.g., pull, uncoil, unravel, deploy) a filament from a wire store. The mass of the electrode is sufficient to draw a filament behind the electrode while the electrode flies toward a target. The mass of the electrode draws the filament from the wire store and behind the electrode in such a manner that the filament extends between the launch device and the electrode positioned at a target. The mass of an electrode is generally insufficient to cause serious blunt impact trauma to a target. In one implementation, the mass of an electrode is in the range of 2.0 to 3.0 grams, preferably about 2.8 grams for launching a distance of from about 7 feet to about 35 feet, preferably about 15 feet.

An electrode provides a surface area for receiving a propelling force to propel the electrode away from a launch device and toward a target. Movement of the electrode away from the launch device is limited by aerodynamic drag and resistance force (e.g., tension in the filament) that resists drawing a filament from a wire store and pulling the filament behind the electrode in flight toward a target. An electrode has an aerodynamic form for suitable accuracy of hitting a target. On proper impact, an electrode mechanically and electrically couples to a target. An electrode mechanically couples to a filament. An electrode may electrically couple to a filament. One or more electrodes form a circuit with a target. The circuit delivers a stimulus signal from the launch device through the target.

An electrode includes a shape for receiving a propelling force to propel the electrode toward a target. A shape of an electrode may correspond to a shape of the portion of the launch device or deployment unit that provides a propelling force to propel the electrode. For example, a cylindrical electrode may be propelled from a cylindrical tube of a deployment unit. During launch by an expanding gas, the body of an electrode may seal the tube to direct a propelling force of the expanding gas against the body of the electrode to accomplish suitable acceleration and muzzle velocity.

In one implementation, an electrode includes a substantially cylindrical body. Prior to launch, the electrode is positioned in a substantially cylindrical tube slightly larger in diameter than the electrode. A propelling force (e.g., rapidly expanding gas) is applied to one end of the tube. The gas pushes against the body of the electrode to propel the electrode out the other end of the tube toward a target.

An electrode includes a shape and a surface area for aerodynamic flight for suitable accuracy of delivery of the electrode, for example, about 15 to 35 feet to a target. An electrode may rotate in-flight to provide spin stabilized flight.

An electrode at least mechanically couples the electrode and/or the filament to a target. Mechanical coupling includes penetrating target tissue, resisting removal from target tissue, coupling to a target surface (e.g., clothing, hair, armor), and/or resisting removal from the target surface. Coupling may be accomplished by piercing, hooking, grasping, entangling, encircling, adhering, and/or gluing. An electrode may include structure (e.g., hook, barb, spear, glue ampoule) for mechanically coupling the electrode to a target. A structure for coupling may penetrate a protective barrier (e.g., clothing, hair, armor) positioned on an outer surface of a target. In one implementation, an electrode includes a spear (e.g., pointed shaft, pointed protrusion) for penetrating a target surface and/or target tissue. The spear may include a barb for increasing the strength of the mechanical coupling of the electrode to the target.

An electrode electrically couples the electrode and/or the filament to a target. Electrical coupling may include directly contacting target tissue and/or ionizing air in a gap to establish an electrical path. An electrode that penetrates or contacts target tissue electrically couples to a target thereby permitting delivery of a stimulus signal through the target. An electrode positioned near, but not contacting, target tissue does not electrically couple to the target; however, an electronic weapon may provide a stimulus signal that may establish an electrical path. Generally, an electrode positioned near a target is separated from target tissue by a gap of air. The electrode may electrically couple to target tissue by conducting a stimulus signal that ionizes air in the gap to establish an ionization path for delivery of the stimulus signal through the target. Providing a high voltage (e.g., 25,000 volts) for at least a portion of the stimulus signal to an electrode positioned within an ionization distance (e.g., about one inch) of target tissue, ionizes air in the gap between the electrode and target tissue thereby electrically coupling the electrode to the target. An electrode so coupled remains electrically coupled to the target for the duration of ionization in the gap.

An electrode mechanically couples to a filament to pull the filament from a wire store and to extend the filament from a launch device to the electrode positioned at a target as discussed above. A mechanical coupling may be established between a filament and an electrode in any conventional manner (e.g., threading the filament through a hole in the electrode and knotting the filament to prevent unthreading, tying the filament in a knot to a portion of the electrode, gluing the filament to the electrode, joining (e.g., welding, soldering) a conductive portion of the filament to a metallic portion of the electrode). Coupling includes coupling a filament and an electrode with sufficient strength to retain the coupling during manufacture, prior to launch, during launch, after launch, during mechanical coupling of the electrode to a target, and while delivering a stimulus signal to a target. According to various aspects of the present invention, suitable mechanical coupling may be accomplished by confining the filament in a portion of the electrode. For example, confining a portion of the filament in an interior of the electrode. Confining may include enclosing, holding, retaining, maintaining mechanical coupling, and/or resisting separation. Confining may be accomplished by preventing or resisting movement or deformation (e.g., stretching, twisting, bending) of the filament. As discussed below, placing the filament in an interior of an electrode and affixing a spear over the interior in one implementation confines the filament to the interior.

A mechanical coupling that requires the filament to bend at an acute angle may weaken the filament and diminish the strength of the mechanical coupling. A mechanical coupling that concentrates a force to a small portion of the filament increases a likelihood of breakage of the filament and failure of the mechanical coupling.

According to various aspects of the present invention, a mechanical coupling between a filament and an electrode spreads the coupling force along a substantial end portion of the filament (e.g., from 0.1 to 1.5 inches) to avoid a single point of concentration of force. Further, the mechanical coupling does not bend the filament at an acute angle (e.g., less than about 120 degrees) or substantially alter the structure of the filament to accomplish mechanical coupling, thereby preserving the inherent mechanical strength of the filament.

An electrode may electrically couple to a filament so that the electrode may be included in an electrical circuit through a target to deliver a stimulus signal through the target. A filament conducts the stimulus signal. For instance, physical contact (e.g., touching) between a conductor of a filament and a metallic portion of an electrode establishes an electrical coupling. An electrical coupling between the conductor of a filament and a metallic portion of an electrode may be accomplished by mechanically coupling the filament to the electrode as discussed above. A mechanical coupling may position and hold a conductor of a filament in contact with a metallic portion of an electrode. A mechanical coupling may maintain an electrical coupling during all phases of operation of the electronic weapon.

A filament may include an insulator. An insulator may be positioned around the conductor of a filament to separate the conductor from contact that may form undesirable electrical connections (e.g., a short between filaments). Forming an electrical connection between a filament and an electrode may include penetrating or removing at least a portion of the insulator to form the electrical connection. For example, an electrode may break the integrity of the insulator by piercing the insulator to establish contact between the conductor of the filament and a metallic portion of the electrode. Staking a filament with (e.g., into, onto) a portion of an electrode may defeat a portion of the insulator (e.g., cutting, removing, penetrating) to facilitate formation of an electrical connection between the conductor of the filament and the electrode during operation.

An electrical coupling between an electrode and a filament having an insulator may also be established by ionizing, as discussed above, air in a gap between the conductor of the filament and the electrode. The conductor of an insulated filament may be exposed to air at an end of the filament. For example, cutting the filament to length generally exposes the conductor at the cut end of the filament. The conductor of the filament may be positioned proximate to, but not touching, a metallic portion of the electrode. A voltage of the stimulus signal may ionize air in the gap between the conductor of the filament and the metallic portion of the electrode to establish an electrical coupling for a duration of ionization in the gap. With small dimensions of the gap between the conductor of the filament and the metallic portion of the electrode, a relatively low voltage (e.g., 200V-400V) stimulus signal may ionize air in the gap to establish an electrical coupling.

Ionizing air to establish an ionization path between the conductor of a filament and a metallic portion of an electrode may result in melting some portion of the metal of the conductor of the filament or the metallic portion of the electrode. Each time air in the gap is ionized, according to various aspects of the present invention, a predictable portion of metal is melted resulting in a cumulative and measurable indication (e.g., record, sign, evidence) of providing a stimulus signal. Analysis of such indicia may provide information about use of an electronic weapon.

The circuit formed between the electronic weapon and the target via the electrode may be used to deliver a stimulus signal through the target. A single electrode may electrically couple an electronic weapon to a target and complete a circuit to deliver the stimulus signal through the target and through earth back to an earth-grounded electronic weapon. Two or more electrodes may electrically couple to a target to form a circuit that includes a path through target tissue between two of the two or more electrodes. Two or more electrodes may couple to a signal generator of the electronic weapon via their respective filaments. The signal generator may provide the stimulus signal through the circuit that includes the electrodes and target tissue.

An electrode, according to various aspects of the present invention, includes a spear and a body. A spear couples an electrode to a target. A spear may penetrate a protective barrier on an outer surface of a target. A spear may penetrate target tissue. A spear may resist decoupling from a target. A spear may deliver a stimulus signal through a target. A spear may mechanically couple to a body of an electrode to form an electrode. A spear generally extends from the body. A spear may electrically couple to a filament. A spear may electrically couple to the body. A spear may mechanically couple to the filament. A spear may include one or more structures and/or spaces for confining and coupling as discussed above. A structure for confining and/or coupling may include a protrusion and/or an undulation.

A body, according to various aspects of the present invention, has a shape and surface that contributes to aerodynamic flight of the electrode from an electronic weapon (e.g., from a deployment unit) to a target. A body mechanically couples to a spear to form the electrode. A body is positioned behind a spear with reference to the direction of flight toward a target. A body may mechanically couple to a filament. A body may have one or more structures and/or spaces for staking as discussed above. A body may electrically couple to a filament. A body may include a substantial portion of the total mass of the electrode. A body provides a surface area for receiving a propelling force to propel the electrode toward a target. A body is propelled away from a deployment unit responsive to a propelling force. A body positioned proximate to target tissue may electrically couple to a target.

According to various aspects of the present invention, a body and/or a spear may have a space to accept deformed material. When a body and a spear are combined to establish mechanical coupling between the spear and the body, deformation of a portion of the spear and/or a portion of the body may result. The deformed material may be accepted into a space of the body, a space of the spear, and/or a space between the body and the spear. By accepting the deformed material into a space of the interior of the electrode, the exterior dimensions of the electrode are preserved. Such a space may be evident after insertion of the filament and spear into the body and before combining the spear and body. Accepting deformed material into such a space reduces a likelihood that the process for combining the body and spear will alter an exterior dimension of the electrode, for example, a diameter of the body at any position along the length of the body. Combining may form a mechanical interference (e.g., staking, joining, covering, holding, grasping, interdigitating, folding, latching, closing an interior). Combining preferably comprises staking.

According to various aspects of the present invention, a method of assembling an electrode includes staking a spear into an interior (e.g., a radial passage extending along an axis of symmetry or direction of flight) of a body. Staking generally includes fastening two components by creating an interference fit between the two components. For example, staking may be accomplished by pressing together (e.g., forcing) a spear and an interior of a body. Staking may include deforming a structure of the interior to attain and/or increase an interference fit. Deforming may be accomplished by pressing together a portion of the spear and suitable structure adjacent to the interior. The structure may deform to fasten or hold together the spear and body. Staking may reduce the possibility of deforming an exterior of the body in a manner that produces diameters of the body at one or various positions along the length of the body that are so large as to cause mechanical interference when the electrode is assembled into a deployment unit (e.g., a cylindrical tube of a deployment unit as discussed herein).

Tooling used for staking is generally simpler and easier to adjust than tooling for crimping. For example, crimping may require confining a body within a perimeter or area. In contrast, a body according to various aspects of the present invention, may include space for accepting material of the body deformed by staking so that change to the external dimensions of the body is unlikely or tolerable without confining a substantial portion of the body within tooling as would generally be the case for a crimping operation.

According to various aspects of the present invention, a method of assembling an electrode includes staking a spear into an interior of a body whereby staking accomplishes mechanical coupling of the filament and the body; and accomplishes electrical coupling of the filament and the body and/or the spear. Staking in this way simplifies assembly, reduces costs of manufacturing, and facilitates automated manufacturing.

An electrode for use with an electronic weapon, according to various aspects of the present invention, performs the functions discussed herein. For example, any of electrodes 142, 236, 238, 300, and 900 of FIGS. 1-16 may be launched from weapon 100 toward a target to establish an electrical circuit with the target to provide a stimulus signal through the target.

Electronic weapon 100 of FIG. 1 includes launch device 110 and deployment unit 130. Launch device 110 includes user controls 112, processing circuit 114, power supply 116, and signal generator 118. In one implementation, launch device 110 is packaged in a housing. The housing may include a mechanical and electrical interface for a deployment unit.

A user control is operated by a user to initiate an operation of the weapon. User controls 112 may include a trigger operated by a user. When user controls 112 are packaged separately from launch device 110, any conventional wired or wireless communication technology may be used to link user controls 112 with processing circuit 114.

A processing circuit controls many if not all of the functions of an electronic weapon. A processing circuit may initiate a launch of one or more electrodes responsive to a control. A processing circuit may control an operation of a signal generator to provide a stimulus signal. For example, processing circuit 114 receives a signal from user controls 112 indicating user operation of the weapon to launch an electrode and provide a stimulus signal. Processing circuit 114 provides a launch signal 152 to deployment unit 130 to initiate launch of one or more electrodes. Processing circuit 114 may provide a signal to signal generator 118 to provide the stimulus signal to the launched electrodes. Processing circuit 114 may include a conventional microprocessor and memory that executes instructions stored in memory.

A power supply provides energy to operate an electronic weapon and to provide a stimulus signal. For example, power supply 116 provides energy (e.g., current, pulses of current) to signal generator 118 to provide a stimulus signal. Power supply 116 may further provide power to operate processing circuit 114 and user controls 112.

A signal generator provides a stimulus signal for delivery through a target. A signal generator may transform energy provided by a power supply to provide a stimulus signal having suitable characteristics (e.g., ionizing voltage, charge delivery, voltage, charge per pulse of current, current pulse repetition rate) to interfere with target locomotion. A signal generator electrically couples to a filament to provide the stimulus signal through the target as discussed above. For example, signal generator 118 provides a stimulus signal (e.g., pulsed current) to electrodes 142 of deployment unit 130 via their respective filaments (e.g., wires in store 140). Signal generator 118 is electrically coupled to filaments stored in wire store 140 via stimulus interface 150.

A deployment unit (e.g., cartridge, magazine) receives a launch signal from a launch device to initiate a launch of one or more electrodes and a stimulus signal to deliver through a target. A spent deployment unit may be replaced with an unused deployment unit after some or all electrodes of the spent deployment unit have been launched. An unused deployment unit may be coupled to the launch device to enable additional electrodes to be launched. A deployment unit may receive signals from a launch device to perform the functions of a deployment unit via an interface.

For example, deployment unit 130 includes two or more cartridges 132-134. Each cartridge 132-134 includes propellant 144, one or more electrodes 142, and wire store 140. A wire store stores a filament for each electrode. Each filament mechanically and electrically couples to an electrode as discussed above. Processing circuit 114 initiates activation of propellant 144 for a selected cartridge via launch signal 152. Propellant 144 propels one or more electrodes 142 toward a target. Each electrode is coupled to a respective filament in wire store 140. As each projectile flies toward the target, each electrode draws its respective filament out from wire store 140. Signal generator 118 provides the stimulus signal through the target via stimulus interface 150 and the filaments coupled to electrodes 142.

Figure 2:
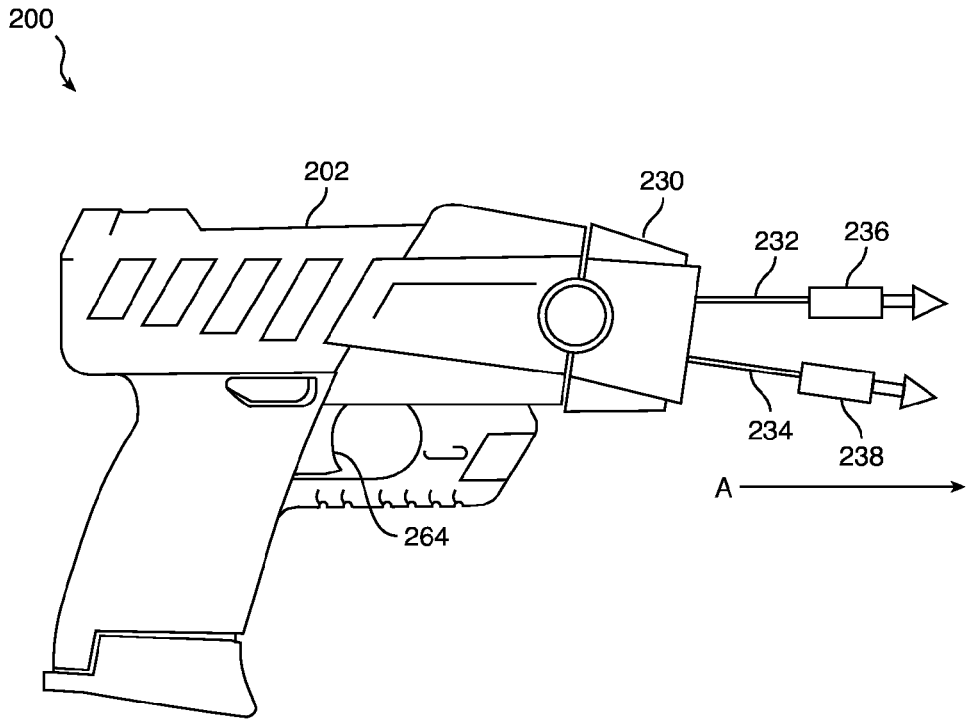
FIG. 2 is side plan view of an implementation of the electronic weapon of FIG. 1.
Figure 3:
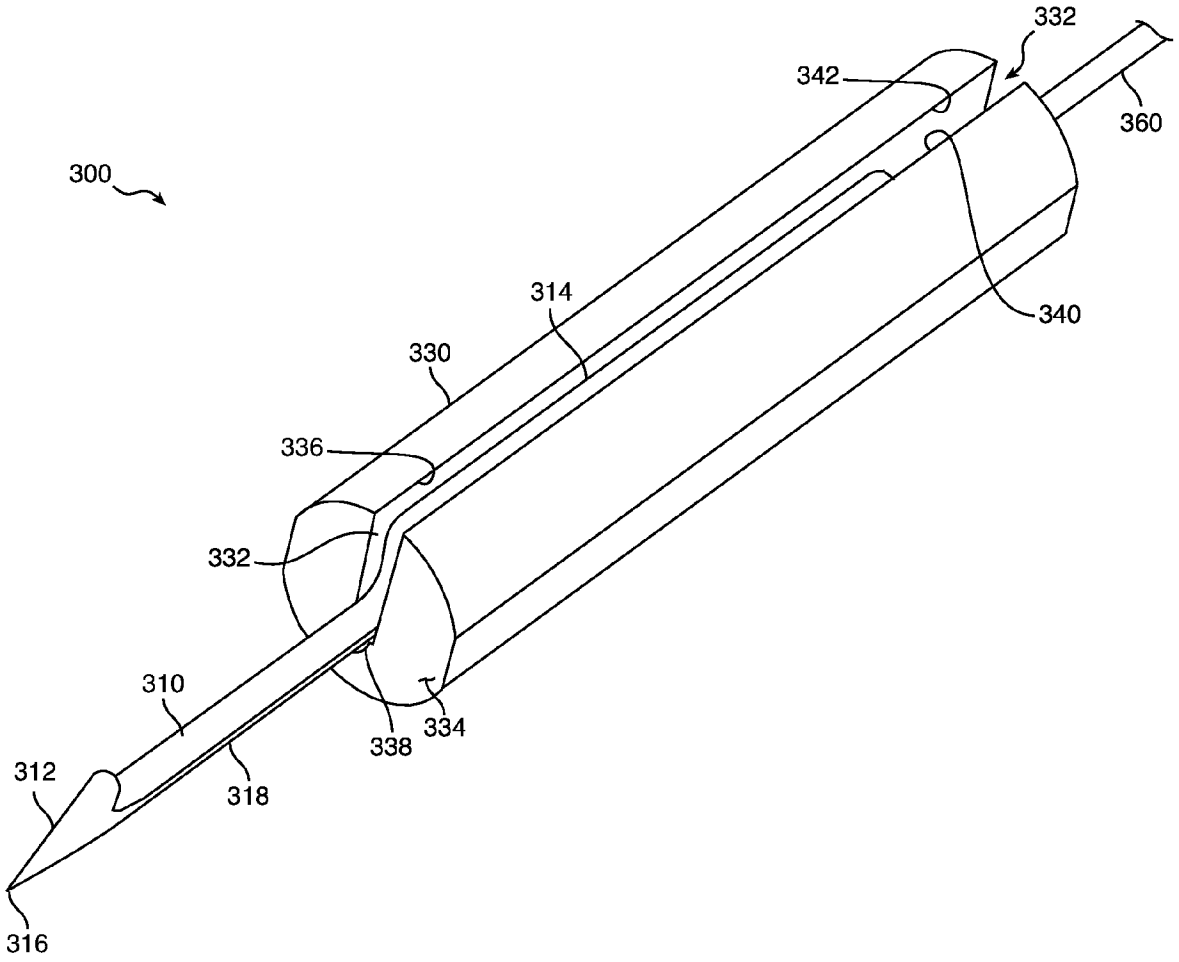
FIG. 3 is a perspective plan view of an electrode of the electronic weapon of FIG. 1.
Figure 4A:
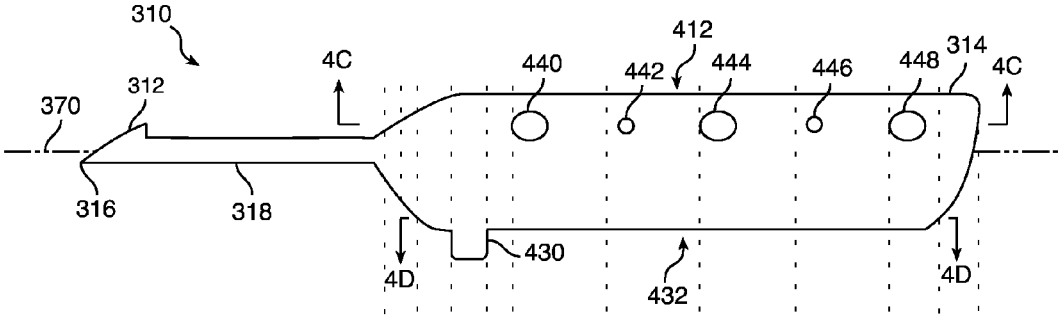
FIG. 4A is a side plan view of a spear of the electrode of FIG. 3.
Figure 4B:
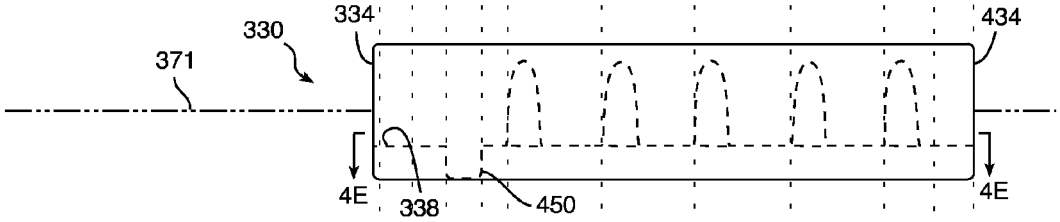
FIG. 4B is a side plan view of a body of the electrode of FIG. 3.
Figure 4C:
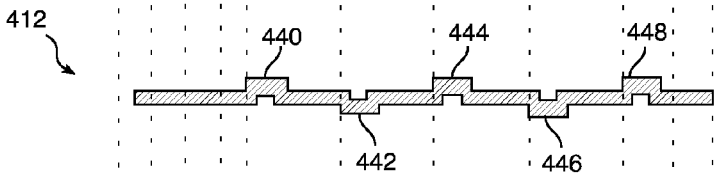
FIG. 4C is a cross-section of the spear of FIG. 4A.
Figure 4D:
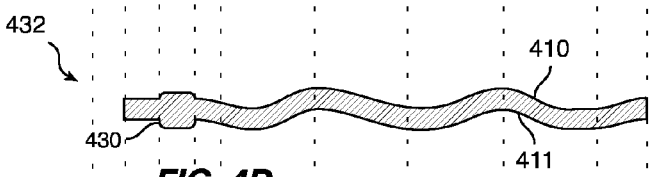
FIG. 4D is another cross-section of the spear of FIG. 4A.
Figure 4E:
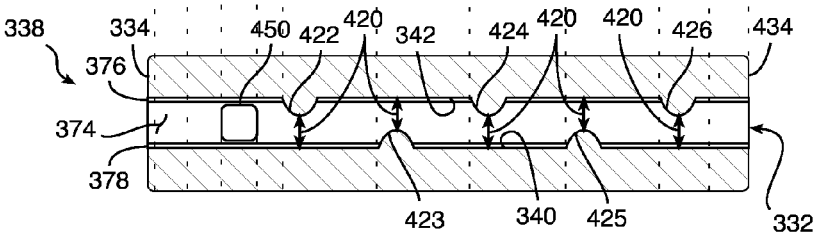
FIG. 4E is a cross-section of the body of FIG. 4B.
Figure 5:
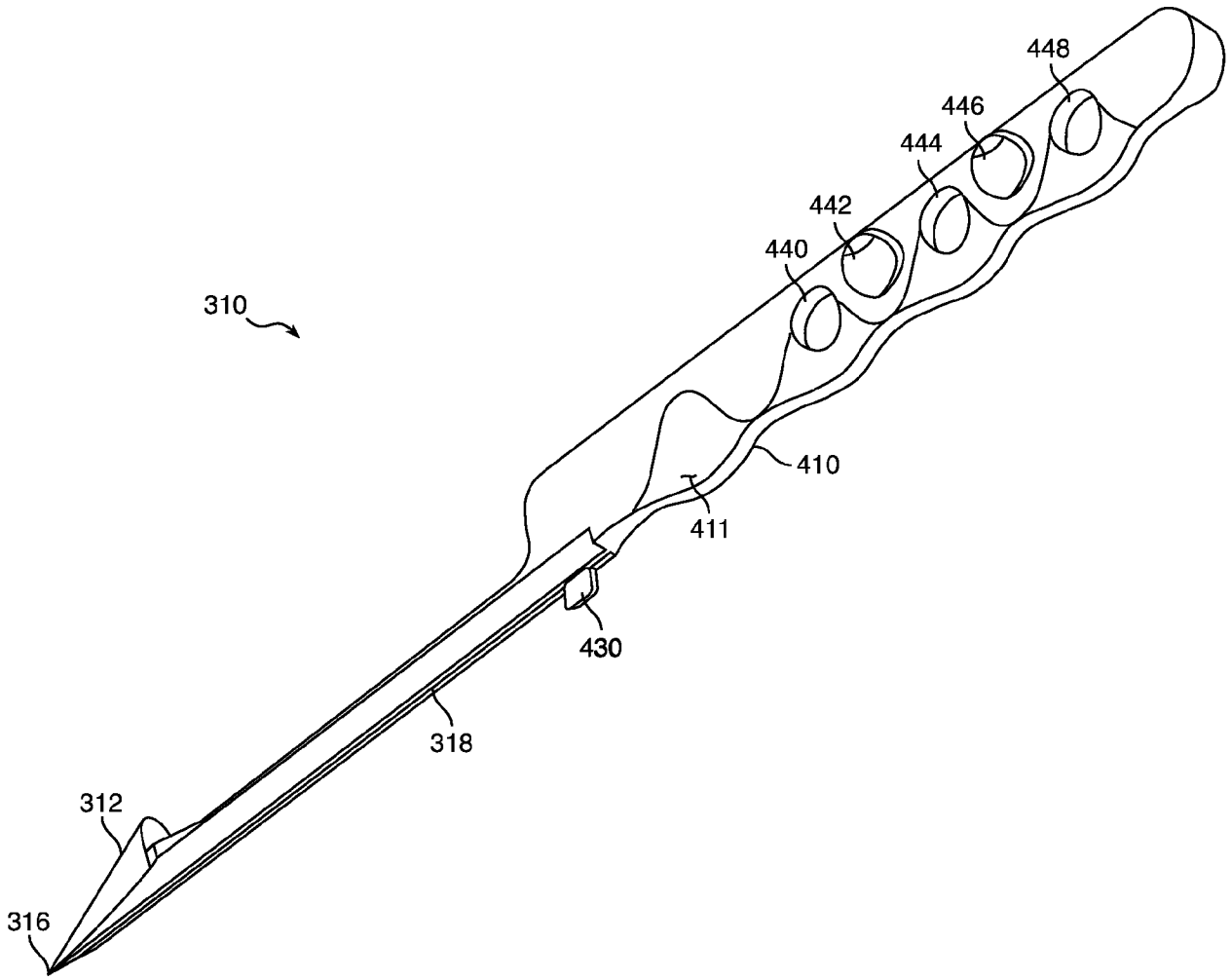
FIG. 5 is a perspective plan view of the spear of FIG. 3.
Figure 6:
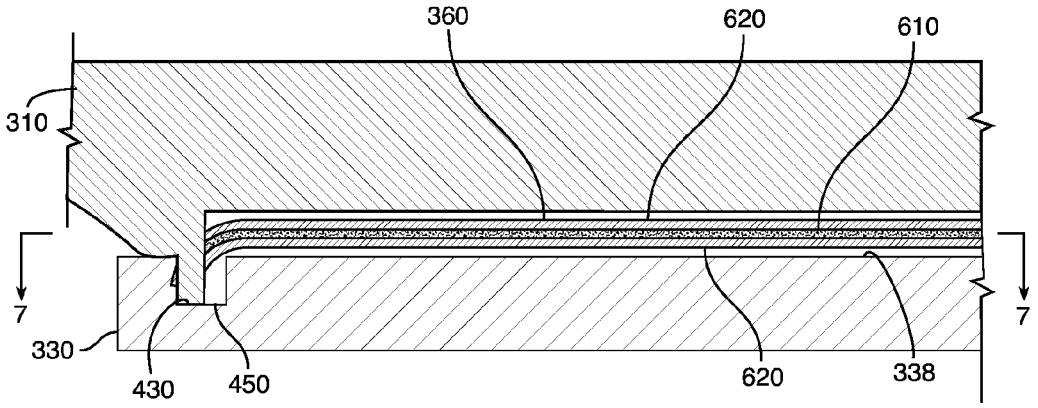
FIG. 6 is a cross-section of a portion of the electrode of FIG. 3.
Figure 7:
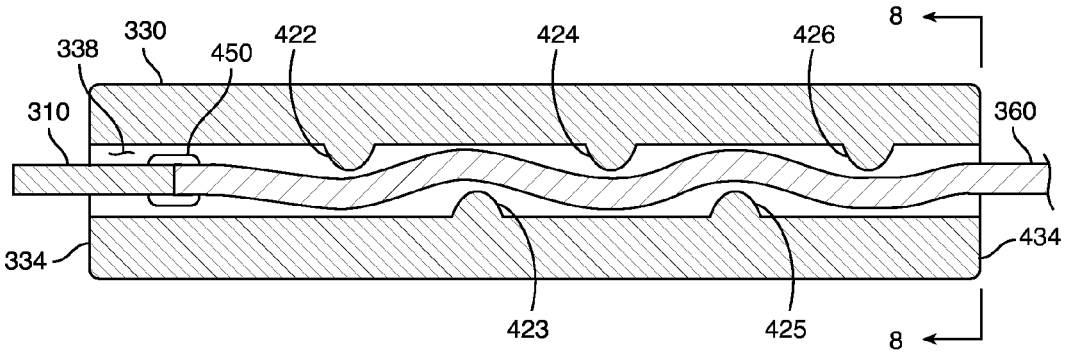
FIG. 7 is a cross-section of a portion of the electrode of FIG. 3 with a filament positioned in an interior of the body.
Figure 8:
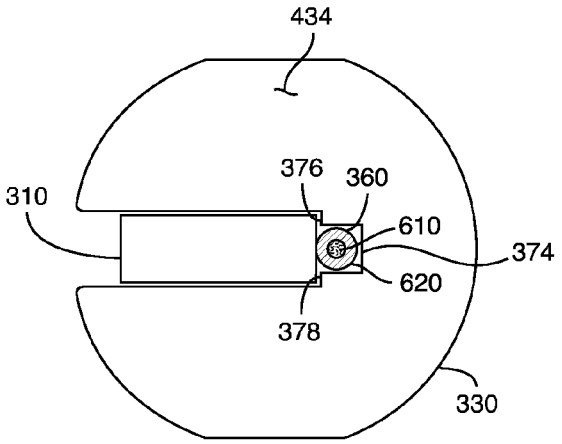
FIG. 8 is a rear view of the electrode of FIG. 3.
Figure 9:
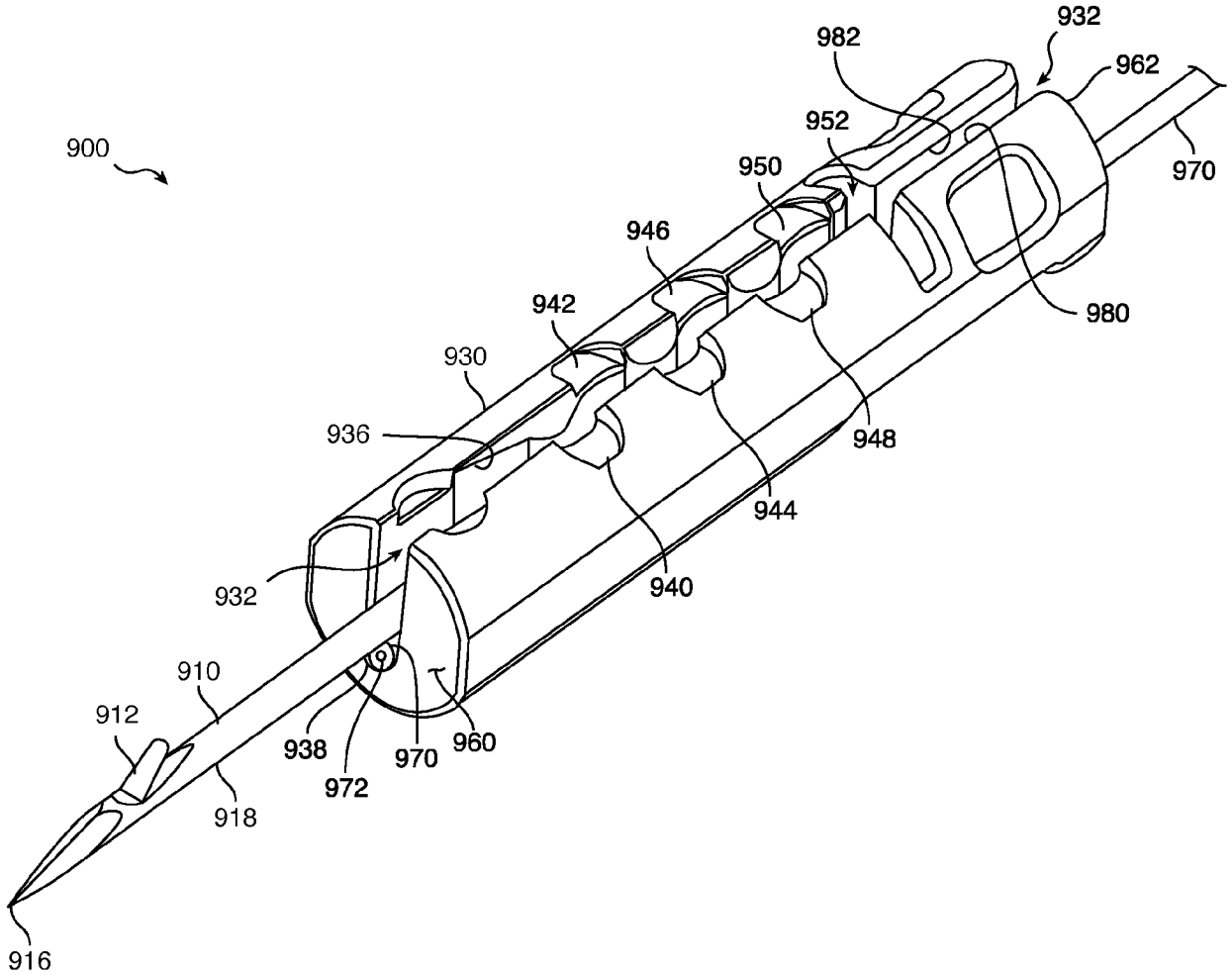
FIG. 9 is a perspective plan view of another electrode of the electronic weapon of FIG. 1.
Figure 10:
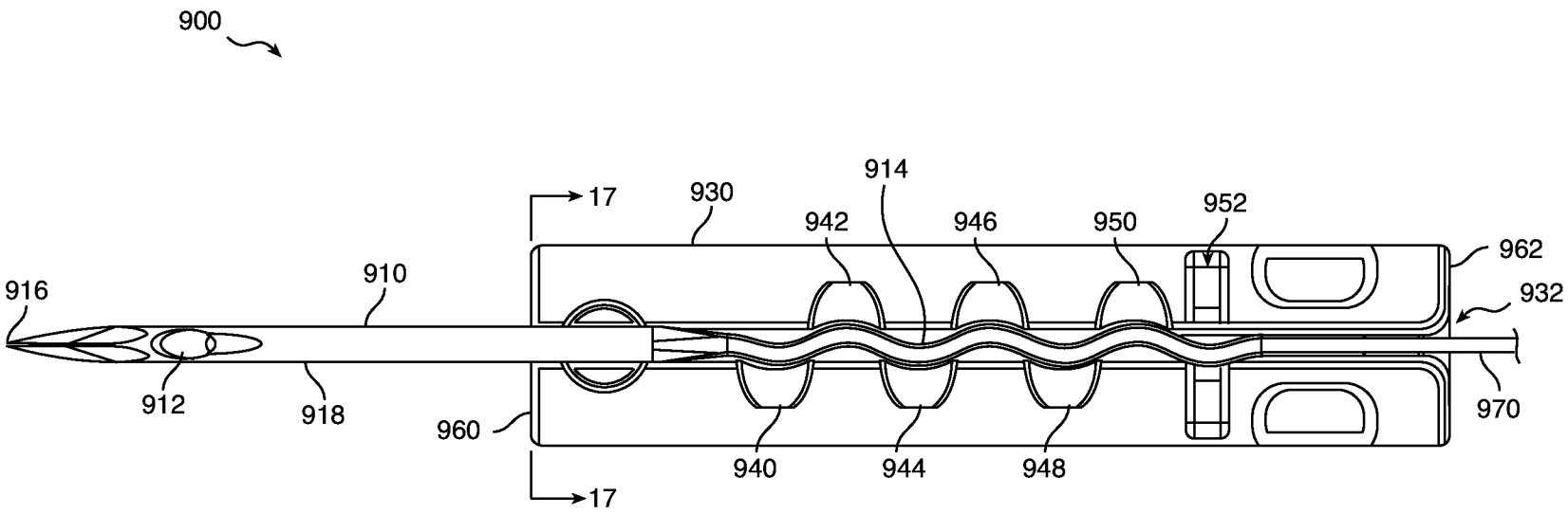
FIG. 10 is a top view of the electrode of FIG. 9.
Figure 11:
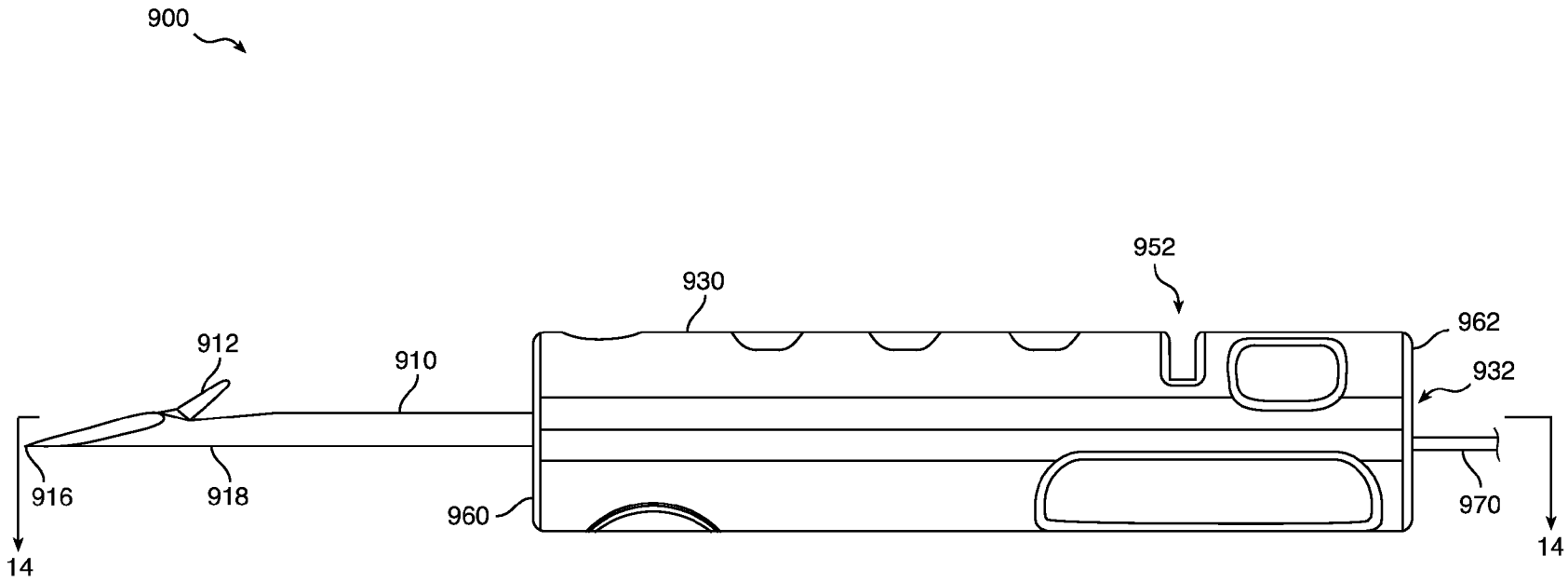
FIG. 11 is a side view of the electrode of FIG. 9.
Figure 12:
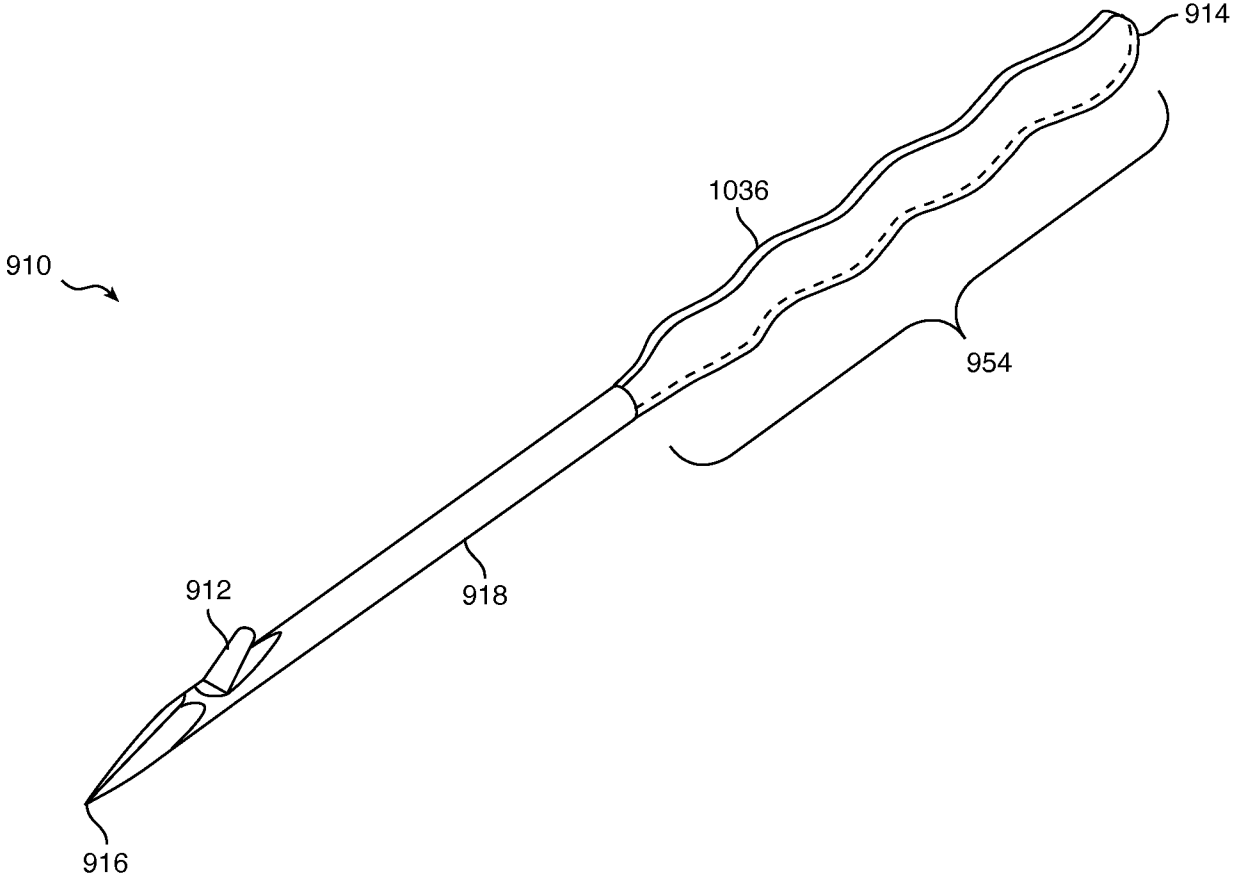
FIG. 12 is a perspective view of a spear of FIG. 9.
Figure 13:
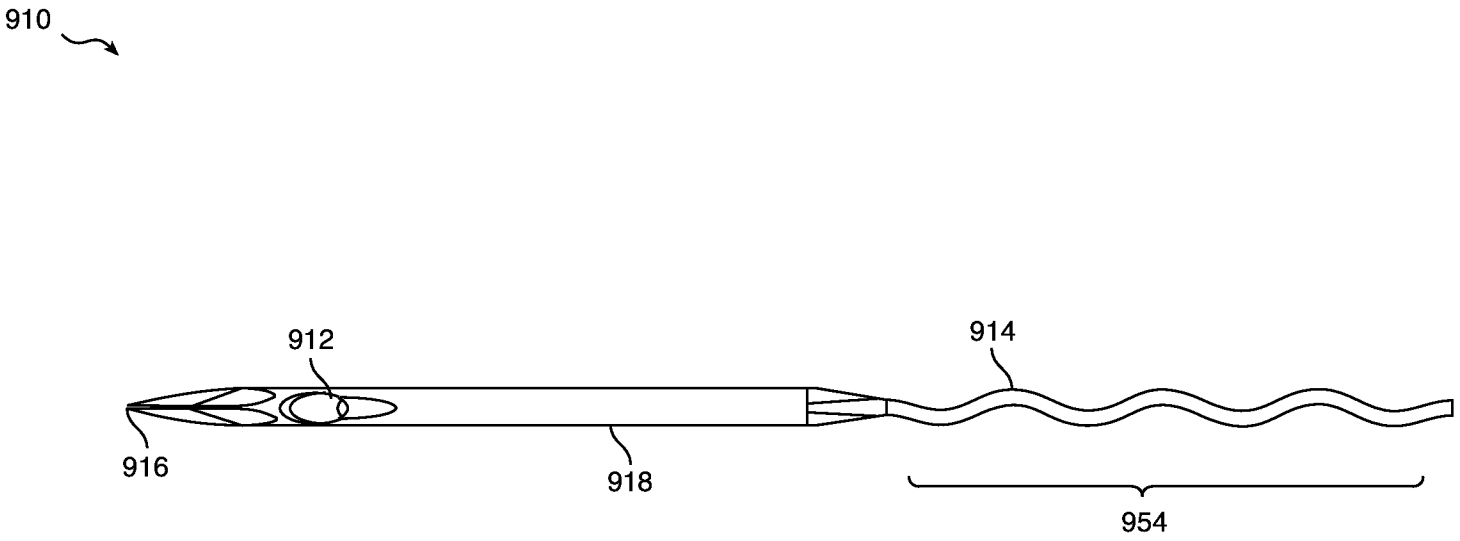
FIG. 13 is a top view of the spear of the electrode of FIG. 12.
Figure 14:
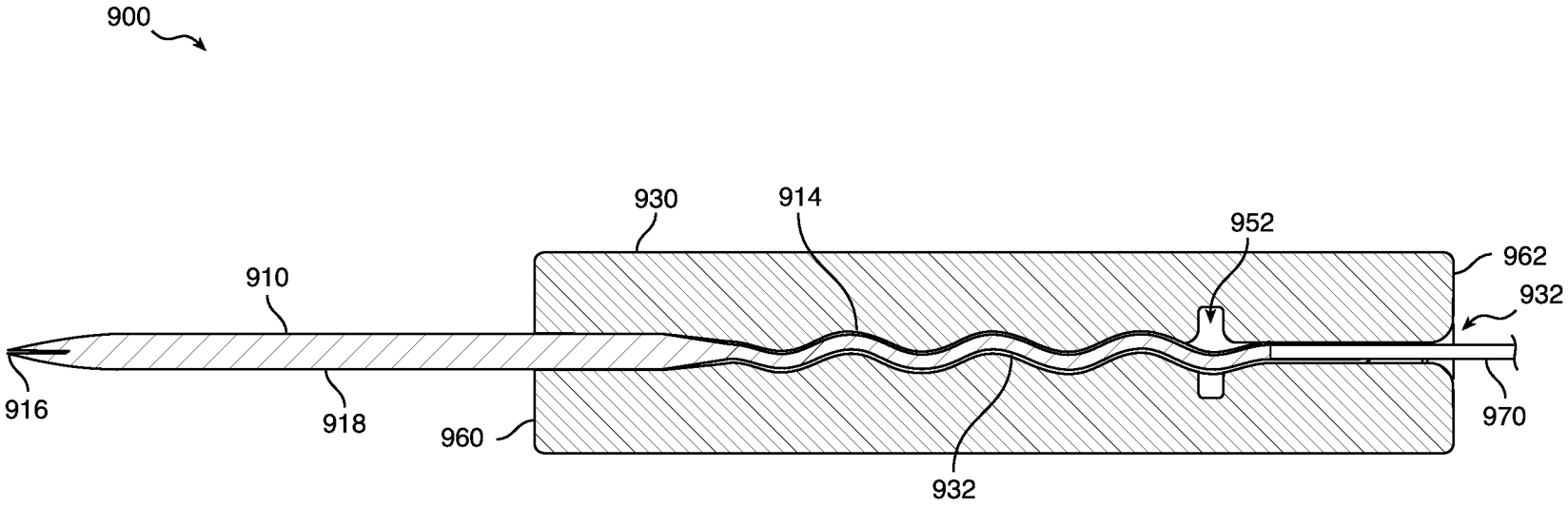
FIG. 14 is a cross-section of the electrode of FIG. 11.
Figure 15:
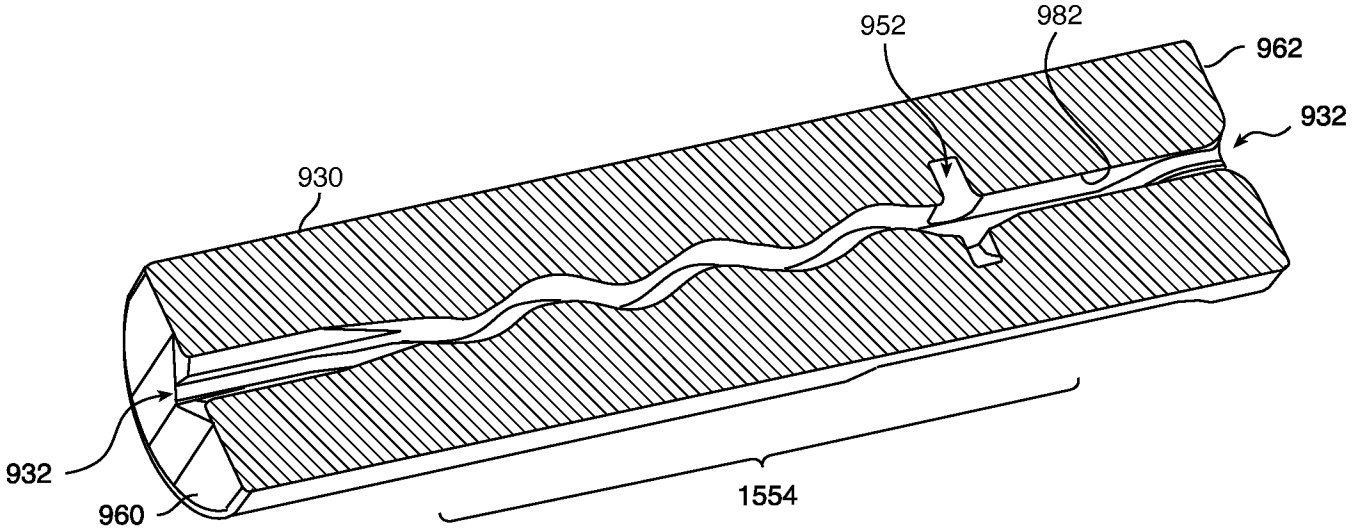
FIG. 15 is a perspective cut-away view of a bottom portion of the body of the electrode of FIG. 11 without the spear and filament.
Figure 16:
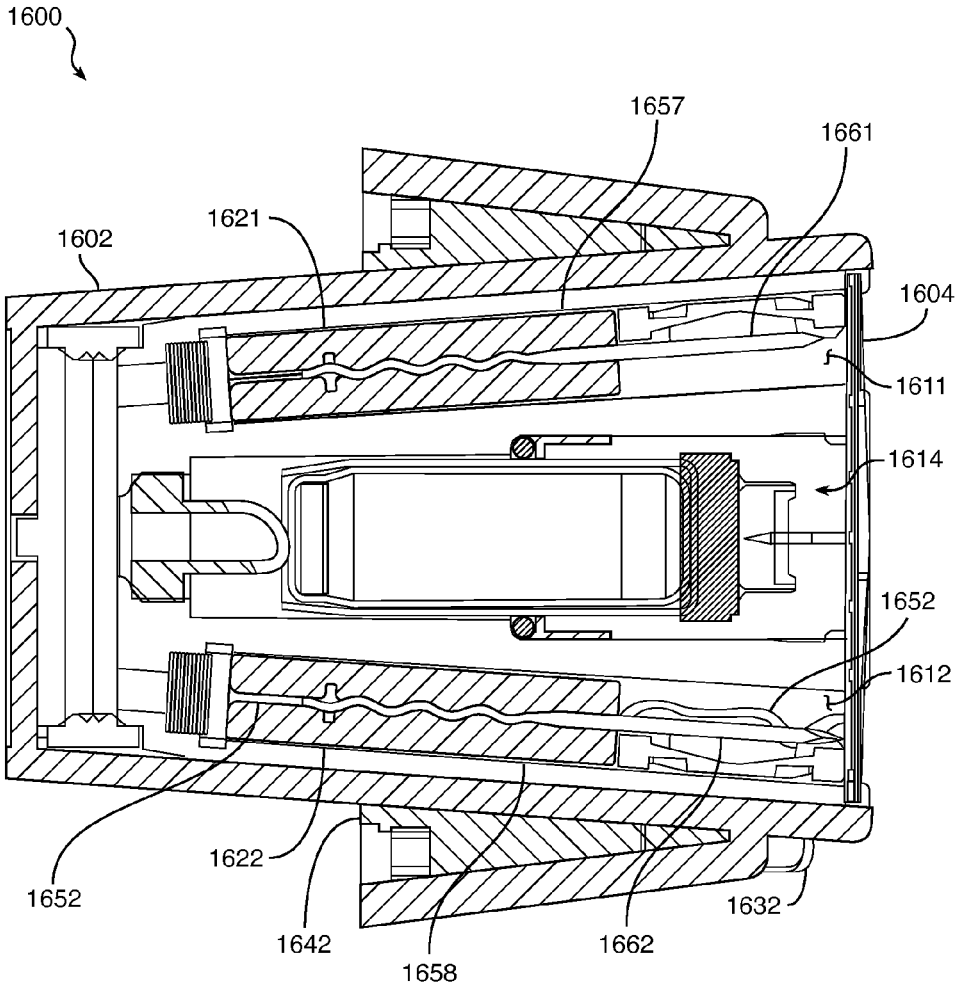
FIG. 16 is a cross section of an implementation of the deployment unit of the electronic weapon of FIG. 2.

In one implementation of an electronic weapon 200 of FIG. 2, a hand-held launch device 202 couples to one field-replaceable cartridge 230. Launch device 202 houses a power supply (having a replaceable battery), a processing circuit, and a signal generator as discussed above. Cartridge 230 includes two wire-tethered electrodes 236 and 238. Upon operation of trigger 264, electrodes 236 and 238 are propelled from cartridge 230 generally in direction of flight "A" toward a target (not shown). As electrodes 236 and 238 fly toward the target, electrodes 236 and 238 draw behind them filaments 232 and 234 respectively. When electrodes 236 and 238 are positioned in or near the target, filaments 232 and 234 extend from cartridge 230 to electrodes 236 and 238 respectively. The signal generator provides a stimulus signal through the circuit formed by filament 232, electrode 236, target tissue, electrode 238, and filament 234.

In one implementation, electrode 300 of FIGS. 3-8 includes spear 310 and body 330. Spear 310 includes tang 314 and shaft 318. Shaft 318 includes sharp point 316 for penetrating a protective barrier and/or target tissue and barb 312 for resisting extraction of shaft 318 from a material into which shaft 318 is embedded. Shaft 318 extends away from body 330.

Body 330 includes an interior space 332 herein simply referred to as an interior (e.g., opening, passage, fold, hollow, cavity, channel, slot, groove). Interior 332 includes top portion 336 and bottom portion 338. Top portion 336 is open to accept tang portion 314 of spear 310. Interior 332 is defined in part by walls 340 and 342. To assemble spear 310 and body 330, tang 314 enters open top portion 336 and is positioned between wall 340 and wall 342. Tang 314 may mechanically couple to walls 340 and 342 due to a friction fit and/or staking of spear 310 and body 330 to form electrode 300. Tang 314 may mechanically couple to walls 340 and 342 by a snap fit due to flexing of materials of tang 314 and/or walls 340 and 342. Interior 332 is identified empty in FIG. 4E and identified filled at least in part after combining the spear and body in FIGS. 3 and 8. After combining, some of empty interior 332 (which includes cavities behind protrusions 440-448 as in FIG. 4C) is occupied by deformed material originally part of protrusions 422-426, and protrusions 440-448, as discussed below.

Body 330 may be formed of metal (e.g., zinc, aluminum, tin, lead, alloys thereof, preferably a zinc Z3 alloy) using a conventional process (e.g., die casting) that forms protrusions 422-426. Protrusions 422-426 are generally deformed during staking of spear 310 and body 330. By locating these deformable structures inside body 330, deformation of body 330 does not substantially affect an exterior diameter of body 330.

Spear 310 includes protrusions 440-448 on top portion 412 of tang 314 and body 330 includes protrusions 422-426 inside interior 332 to accomplish mechanical coupling between spear 310 and body 330. Each protrusion 440-448 of spear 310 aligns against a respective protrusion 422-426 of body 330. Protrusions 422-426 are less pronounced (e.g., enter interior 332 less) near top portion 336 than near bottom portion 338. As tang 314 enters interior 332 and moves toward bottom portion 338, friction between opposing protrusions 440-448 and protrusions 422-426 is attained. As tang 314 approaches bottom portion 338, interference between protrusions 440-448 and 422-426 increases to provide firm mechanical coupling between spear 310 and body 330.

Spear 310 may be formed from sheet metal (e.g., stainless steel, preferably a 410 or 420 alloy) using a process that forms protrusions 440-448 as half-sheer protrusions. A stamping, coining, skiving, cutting, and/or punching process may be used. Advantageously, such a process is less expensive compared to casting, machining, and/or milling processes and avoids joining of components to form a structure having the functions of a spear as discussed herein.

When spear 310 is formed of 410 or 420 stainless steel, a desired hardness may be attained by conventional heat treatment. For example, the heat treatment may be performed in accordance with the ASTM (American Society for Testing and Materials) number of the selected stainless steel to provide a hardness of between 35 and 50, preferably about 48, on the HRC Rockwell hardness scale.

Bottom portion 432 of tang 314 includes curved surfaces 410 and 411 to facilitate alignment prior to staking and to provide greater physical contact with protrusions 422-426 to accomplish mechanical coupling. A surface having an undulation comprises a curve or series of curves. Tang 314 comprises an undulation comprising portions of surfaces 410 and/or 411.

Spear 310 includes pin 430 that cooperates with cavity 450 of body 330 to align spear 310 in body 330 and to establish an electrical coupling between the conductor of a filament and spear 310 as discussed herein.

Protrusions 422-426 may mechanically couple to an end portion of a filament. Width 420 of interior 332 proximate to bottom portion 338 may be slightly larger than the width of filament 360. In one implementation, the diameter of filament 360 is approximately 0.015 inches. After assembly, filament 360 is positioned in a channel 374 between shoulders 376 and 378 in bottom portion 338 of interior 332. Shoulders 376 and 378 may generally abut tang 314 when staking is complete. Absent a pulling force along a length of filament 360, filament 360 fits around protrusions 422-426 loosely with a little space between filament 360 and the walls of interior 332. Applying a pulling force on filament 360 causes filament 360 to straighten within interior 332. A pulling force may occur during assembly, staking, launching, or removal of electrode 300 from a target. As filament 360 straightens in interior 332, the sides of filament 360 interfere (e.g., contact, conform, engage, grip) with protrusions 422-426 to mechanically couple filament 360 to body 330. Because filament 360 is held in body 330 through interference with multiple protrusions 422-426, no single location of filament 360 experiences the total pulling force. Because the pulling force is not concentrated on a small portion of filament 360, but is distributed over a larger portion of filament 360, filament 360 is less likely to break due to the pulling force. Furthermore, the pulling force is less likely to interrupt any electrical coupling between spear 310 and filament 360 or body 330 and filament 360. Additionally, the shape the undulations of interior 332 do not bend filament 360 at an acute angle thereby decreasing a likelihood of mechanical and/or electrical failure of filament 360.

An uninsulated filament (not shown) may electrically couple to body 330 through mere physical contact with a metallic portion of body 330. An uninsulated filament may electrically couple to spear 310 either through metallic portions of body 330 that contact spear 310 or through physical contact with bottom portion 432 of spear 310. In an electronic weapon that launches two or more electrodes, a short between filaments of the electrodes would frustrate delivery of a current through a target. Conventional electronic weapons that use insulated filaments avoid shorting the filaments to each other during placement of the electrodes proximate to the target.

During assembly of electrode 300, insulated filament 360, being insulated by insulator 620, is placed in interior 332. Filament 360 may enter channel 374 in part or completely. Spear 310 is also placed in interior 332 over filament 360 and pin 430 is positioned over cavity 450. As spear 310 is staked into interior 332, pin 430 presses against and severs filament 360 as pin 430 enters cavity 450. Conductor 610 at the severed end of filament 360 is exposed to air and may contact pin 430 or lie within ionizing distance thereby electrically coupling conductor 610 of filament 360 to spear 310. Protrusion 422 (typical of protrusions 422-426) provides a structure for retaining protrusion 440 (typical of respective protrusions 442-448) after staking spear 310 and body 330. When protrusion 422 extends into channel 374, protrusion 422 also impedes withdrawal of filament 360 from body 330 after staking. The alternating arrangement of protrusions 422-426 increases the filament retaining capability of body 330.

A method for assembling an electrode assembly, according to various aspects of the present invention, includes the following sequence of steps. The method may be practiced, for example, with the structures of FIGS. 3-8 as suggested infra in parentheses. A body (330) is aligned in a fixture (not shown). The end portion of a filament (360) is inserted into an interior (332) of the body (330) so that a portion of the filament (360) extends away from the body (330) at both ends of the body (330). A spear (310) is aligned in the interior (332). Alignment of a pin (430) over a cavity (450) is facilitated by undulations (410 and 411) in a bottom portion of the spear (310) and by protrusions (422-426) of the body (330). The spear (310) and body (330) are then combined (e.g., staked, pressed, forced, advanced) together by movement of the spear (310) and/or the body (330). During staking, an axis of the spear (370) and/or or an axis of the body move toward becoming collinear. Staking is limited when shoulders of the body (376 and 378) abut the spear (310). Staking accomplishes cutting of the filament (360) in a cavity of the interior (450). Then, excess filament is easily pulled out of the body (330) through a face (334) of the body. The electrode (300) is removed from the fixture.

In another method, according to various aspects of the present invention, assembling an electrode includes retaining a body, positioning a filament, inserting the filament into an interior of the body, grasping a tang of a spear, aligning the tang to the body, inserting the aligned tang, deforming tabs, cutting the filament, releasing the tang, and releasing the body.

Retaining the body includes retaining the body in a fixture for automated assembly, using a tool to manually retain the body, or manually holding the body. Retaining includes grasping the body. Retaining includes positioning the body to facilitate performance of additional steps. For example, retaining may position an interior of the body for insertion of a filament and a spear.

Positioning a filament includes positioning a length of filament along a length of an interior of a body. Positioning may include positioning a filament such that a length of the filament extends beyond a front portion of the body and a length of the filament extends beyond a rear portion of the body. The length of filament that extends beyond the rear portion of the body may be greater than the length of filament that extends beyond the front portion of the body. After assembly, the length of filament that extends beyond the rear portion of the body may be stored in a wire store as discussed above.

Inserting the filament into the interior of the body may include inserting a portion of the filament along the length of the interior (e.g., along an axis of symmetry or direction of flight). Inserting the filament includes pressing the filament into the interior such that the filament is positioned in the interior below a top surface of the body. Inserting may include routing the filament over an undulation and/or between undulations.

Grasping a tang includes grasping a portion of a tang of the spear. Grasping includes securing, holding, and pinching. Grasping may be accomplished by grasping with the digits (e.g., fingers) of an assembler or with a tool. Grasping with a tool may be a function performed by a manual assembler or by a machine that performs automated assembly.

Aligning the tang to the interior may include aligning an undulation of the tang of the spear with an undulation of an interior of the body. Aligning may include positioning the tang relative to the interior such that the undulation of the tang matches (e.g., mates with) the undulation of the interior. Aligning may be accomplished by aligning the body and the spear to a reference object so positioned to result in the alignment of the undulations of the tang and the interior.

Inserting the aligned tang into the interior includes moving the tang toward the body, moving the body toward the tang, or both, such that the tang enters the interior. Inserting the tang may further include pressing the tang and the body together. Pressing may further insert the filament deeper into the interior and may or may not establish a friction fit. A tang may be inserted into an interior such that a substantial portion of the filament contacts a bottom portion of the interior.

Deforming a tab includes bending, pressing, and/or distorting a tab. A tab includes a portion of the body positioned along a top portion of the interior. Deforming a tab moves at least a portion of the tab into the interior. Deforming a tab may close a portion of the interior. Deforming a tab creates a structure that mechanically retains the tang in the interior. Deforming a tab does not substantially deform, change, or alter an outer diameter of the body. Preserving the outer diameter of the body permits the body of an assembled electrode to be positioned in a deployment unit without interfering with the deployment unit as discussed above.

Cutting a filament includes severing a filament. Cutting a filament may include severing through an insulator that encloses the filament and/or severing a conductor of the filament. Cutting a filament generally results in a separation of the filament into two portions about the location of the cut. After cutting, the portion of the filament inserted in the body may end substantially flush with a front (e.g., face) portion of the body. A filament may be cut to expose a conductor of the filament. An exposed conductor may electrically couple to the body and/or the spear of an electrode by ionizing air in a gap between the exposed conductor and the body and/or spear of the electrode as discussed above.

Releasing the tang includes releasing the tang from grasping with the digits of an assembler, a tool used by the assembler, or a tool used by an automated assembly machine. Releasing the tang may be accomplished without moving the tang with respect to the interior of the body.

Releasing the body includes releasing the body from the digits of an assembler, releasing the body from a fixture used for manual assembly, or releasing the body from a fixture of an automated assembly machine. Releasing the body permits the now assembled electrode to be combined with a cartridge.

Inserting the aligned tang into the interior and deforming tabs of the body accomplishes mechanical coupling of the spear to the body. Cutting the filament at a front portion of the body accomplishes electrically coupling the body and/or the spear to the filament by exposing a conductor of the filament to ionize air in a gap between the conductor and the body and/or spear as discussed above.

The steps of inserting the filament, inserting the tang, and deforming the tabs simplifies assembly, reduces costs of manufacturing, and facilitates automated manufacturing of an electrode compared to prior art electrodes. The steps of inserting the filament and cutting the filament reduces stress on and damage to the filament thereby reducing the cost of manufacture, increasing the reliability of an electrode, and facilitating automated manufacture.

An electrode suitable for assembly using the above method may be implemented as electrode 900 of FIGS. 9-16. Electrode 900 includes body 930 and spear 910. Body 930 and spear 910 mechanically and electrically couple to form electrode 900. Electrode 900 performs the functions of an electrode as discussed above.

Body 930 includes an interior space (as discussed above) herein simply called an interior 932, front face 960, rear face 962, tabs 940-950, interior 952, and undulation 1554. Interior 932 includes top portion 936, bottom portion 938, wall 980, and wall 982. Spear 910 includes tang 914 and shaft 918. Shaft 918 includes sharp point 916 and barb 912. Tang 914 includes undulation 954. Interior 932 is identified empty in FIG. 15 and identified filled at least in part after combining the spear and body in FIGS. 9, 10, 11 and 14. After combining, some of empty interior 932 is occupied by deformed material originally part of tang 914 and/or tabs 940-950, as discussed below.

Body 930 performs the functions of a body discussed above. Interior 932 receives spear 910 and filament 970 for electrical and mechanical coupling. Bottom portion 938 supports filament 970. Walls 980 and 982 enclose filament 970 and tang 914. Interior 952 facilitates insertion of spear 910 into interior 932 of body 930 during assembly. Tabs 940-950, undulation 1554, and undulation 954 cooperate to mechanically coupled spear 910 to body 930. Body 930 is formed of a malleable metal (e.g., zinc, aluminum, tin, lead, alloys thereof, preferably a zinc Z3 alloy) using a conventional process (e.g., die casting).

Spear 910 performs the functions of a spear as discussed above. Spear 910 may penetrate a protective barrier positioned on an outer surface of a target. Sharp point 916 facilitates penetration of a protective barrier as discussed above.

Barb 912 facilitates mechanical coupling of spear 910 to a target as discussed above. Tang 914 mechanically couples spear 910 to body 930. Tang 914 may further electrically couple spear 910 to body 930.

Top portion 936 of interior 932 is open to accept filament 970. Filament 970 after assembly of electrode 900 rests on bottom portion 938. Top portion 936 of interior 932 further accepts tang 914, which after assembly of electrode 900 is positioned against filament 970 and between wall 980 and 982. Interior 952 permits entry and removal of a tool that grasps spear 910 to insert and retain tang 914 in interior 932 during assembly.

The shape of undulation 954 matches the shape of undulation 1554 to facilitate alignment of tang 914 in body 930 and to permit tang 914 to be positioned in interior 932. Matching curved surfaces further provide greater physical contact between tang 914 and walls 980 and 982 to assist in mechanically coupling spear 910 to body 930. The curved shape of undulations 954 and 1554 cooperate to mechanically couple spear 910 to body 930. The interference between undulation 954 and undulation 1554 restricts movement of spear 910 in the directions of front 960 to rear 962 of body 930 and vice versa, for example, along an axis of symmetry or direction of flight of body 930.

Tabs 940-950 with tang 914 cooperate to retain spear 910 in body 930. After tang 914 is inserted into interior 932, tabs 940-950 are deformed to abut top 1036 of tang 914. Deforming tabs 940-950 prohibits tang 914 from exiting interior 932. Deforming mechanically and electrically couples spear 910 to body 930. Deformation of tabs 940-950 does not substantially affect an outer diameter of body 930, thereby facilitating placing electrode 900 in a deployment unit (e.g., a tube of a deployment unit) without creating interference with the deployment unit.

Undulation 1554 mechanically couples filament 970 to body 930. Bottom portion 938 of interior 932 is slightly larger than the width of filament 970. In one implementation, the diameter of filament 360 is approximately 0.015 inches. As discussed above with respect to filament 360, an end portion of filament 970 is positioned in bottom portion 938 of interior 932. After assembly, filament 970 is positioned in interior 932 between the curves of undulation 1554. Absent a pulling force on an end of filament 970, filament 970 fits around the curves of undulation 1554 loosely with a little space between filament 970 and walls 980 and 982 of interior 932. Applying a pulling force on filament 970 causes filament 970 to straighten within interior 932. As filament 970 straightens in interior 932, the sides of filament 970 interfere with the curves of undulation 1554 to mechanically couple filament 970 to body 930. As discussed above, because filament 970 is held in body 930 through interference with multiple curved surfaces, no single location of filament 970 experiences the total pulling force, thereby reducing a likelihood of breakage due to the pulling force. Furthermore, filament 970 is not bent at an acute angle thereby further reducing a likelihood of mechanical or electrical failure of filament 970.

Tabs 940-950 may provide a surface for ejector pins to eject body 930 from a die cast mold used to manufacture body 930. Any conventional die casting process may be used to form body 930. Body 930 may be formed of any material (e.g., zinc, aluminum, tin, lead, alloys thereof, preferably a zinc Z3 alloy) suitable for a conventional metal die casting process. Body 930 may further be formed using a molding process that molds any material (e.g., plastic, metal, carbon, compositions thereof) that provides a suitable mass for body 930 for suitable flight characteristics as discussed above. Body 930 when formed using a die casting process may have any suitable porosity.

Spear 910 may be formed from a metal (e.g., stainless steel, preferably a 302 or 304 alloy) using a stamping, coining, skiving, cutting, and/or punching process. Advantageously, such a process is less expensive compared to casting, machining, and/or milling processes and avoids joining of components to form a structure having the functions of a spear as discussed herein. For example, spear 910 may be formed from a wire that is stamped to form spear 910. In one implementation, formation of spear 910 begins with a stainless steel wire having a diameter of 0.035 inches that is formed by a stamping process to have the shape and characteristics discussed herein. A spear 910 formed of 302 or 304 stainless steel is preferably not heat treated.

As discussed above, an uninsulated filament may electrically couple to body 930 or spear 910 through mechanical contact with a metallic portion of body 930 or spear 910.

During assembly of electrode 900, for example, insulated filament 970 is placed in interior 932. Undulation 954 of tang 914 is aligned with undulation 1554 of interior 932. Then spear 910 is inserted in interior 932 over filament 970. Spear 910 is pressed into interior 932 and tabs 940-950 are deformed to retain tang 914 in interior 932. Deforming tabs 940-950 retains tang 914 in interior 932. Filament 970 may initially exit interior 932 from both front 960 and rear 962 of body 930. Filament 970 is then cut flush with front 960 of body 930. Cutting filament 970 severs insulator and conductor of filament 970. Cutting filament 970 exposes the conductor of filament to air facilitating ionization as discussed above.

The exposed conductor of filament 970 electrically couples to a metallic portion (e.g., spear 910, body 930) of electrode 900 by ionization of air in the gap between the exposed conductor and a metallic portion of electrode 900 as discussed above. In one implementation, the gap between the conductor and spear 910 or body 930 is less than the diameter (e.g., 0.015 inches) of filament 970. Consequently, a stimulus signal of a relatively low voltage is sufficient to ionize the air in the gap.

As discussed above, each ionization of air in the gap between the exposed conductor and spear 910 or body 930 leaves indicia of ionization thereby facilitating analysis of use of an electronic weapon.

A deployment unit may include one or more electrodes as discussed above. For example, deployment unit 1600 of FIG. 16 includes the exterior dimensions, features, and operational functions, of a conventional cartridge used with model M26 and X26 electronic control devices marketed by TASER International, Inc. For deployment unit 1600, each electrode may be propelled from a cylindrical bore in a housing of the deployment unit. For example, deployment unit 1600 includes housing 1602, cover 1604, wire stores (not shown), bores 1611 and 1612, propellant system 1614 comprising separate components, contacts (one shown) 1632, and wire-tethered electrodes 1621 and 1622. Each wire-tethered electrode 1621 (1622) includes a respective filament (one shown) 1652, a respective body 1657 (1658), and a respective spear 1661 (1662). Wire stores are located on both sides of the plane of the bores of the housing, so that in the cross section view of FIG. 16, one wire store is removed by cross section and the other is hidden. Two contacts are located diagonally opposite each other near the corners of rectangular cover 1604. The stimulus signal is routed from the launcher through the deployment unit via the contacts. Each contact electrically couples to a respective end of a filament. For example, one end of filament 1652 exits a wire store and is held by wedge

1642 proximate to contact 1632; while the other end of filament 1652 passes out of the front of the wire store near cover 1604, passes near spear 1662, passes along the length of body 1658, and enters a rear face of body 1658 as discussed above.

A method of deployment unit assembly includes, inter alia, in any practical order: (a) placing the electrode of the wire-tethered electrode assembly in a bore of the housing, (b) storing the filament in a wire store, and (c) attaching each tether wire to the housing. The method may be practiced, for example, with the structures of FIGS. 9-16 as suggested in parentheses. The body (1658) with spear (1662) and filament (1652) attached is fed into a bore (1612). The filament (1652) is neatly placed in a wire store. The loose end of the filament (1652) is mechanically coupled near a contact (1632) to the deployment unit housing (1602) by a wedge (1642). The loose end of the filament (1652) may abut or be held against the contact (1632). A cover (1604) is installed to close the bores of the housing 1602. A close uniform fit of the body in the bore is desired and accomplished as taught above to facilitate manual and/or automated assembly. Any diameter along the length of the body that exceeds a limit interferes unnecessarily with feeding the body into the bore.

In use, the propellant explosively provides a volume of expanding gas that pushes each body 1657 (1658) from the respective bore 1611 (1612). Acceleration, muzzle velocity, flight dynamics, and accuracy of hitting the target are affected by the fit of the body as it leaves the bore. Any diameter along the length of the body that exceeds a limit interferes for a period of time unnecessarily with propelling the body from the bore.

Practice of the inventions discussed above may include performing a method for assembling an electrode for an electronic weapon. The electrode comprises a filament and a body. The filament and/or the electrode provides, in operation, a stimulus signal through a human or animal target to inhibit locomotion by the target. The method comprises conforming the filament to a surface of an undulation of an interior of the body; and deforming the interior to retain the filament in the interior.

The method may further include placing a spear in the interior with the filament before deforming, wherein deforming further retains the spear in the interior with the filament. Further, the spear and a portion of the interior may cooperate as a sheer whereby applying pressure to the spear against the filament and the interior severs a waste portion from the filament.

A deployment unit, according to various aspects of the present invention, is used with an electronic weapon. The electronic weapon provides a stimulus signal through a human or animal target to inhibit locomotion by the target. The deployment unit comprises a housing; at least one filament stored in the housing prior to deployment, and at least one electrode. During deployment, the electrode is launched away from the housing, pulling an end portion of the filament away from the housing. The electrode is mechanically coupled to a first end portion of the filament. A second end of the filament is retained in the deployment unit. An object of deployment is to attach the electrode to the target for providing the stimulus signal through the filament and through tissue of the target. The electrode comprises an interior. The interior comprises an undulation. The first end portion is retained in the interior. In operation, the filament experiences a tensile stress during deployment. The tensile stress follows a nonlinear path along a surface of the undulation.

Practice of the inventions described above may involve making or using a deployment unit for coupling to a provided launch device to deliver a stimulus signal through a human or animal target to inhibit locomotion by the target. The deployment unit comprises a housing; a first electrode in the housing; a second electrode in the housing; a first filament in the housing; a second filament in the housing; and a propellant in the housing for launching the first and second electrodes responsive to the launch device. The first electrode comprises a first spear and a first body. The first body comprises a first interior that confines the first spear over a first end portion of the first filament. The second electrode comprises a second spear and a second body. The second body comprises a second interior that confines the second spear over a second end portion of the second filament. In operation, the first end portion of the first filament experiences a tensile stress during launching. The tensile stress follows a nonlinear path along a surface of an undulation of the first interior.

An electronic weapon has an installed deployment unit from which an electrode, tethered by a filament, is launched. According to various aspects of the present invention, the deployment unit includes a housing, two filaments stored in the housing prior to launching, and two electrodes, each coupled to the end of one of the filaments. A propellant in the housing launches the electrodes responsive to the launch device. In operation, an end portion of each filament experiences a tensile stress during launching. The tensile stress follows a nonlinear path along a surface of an undulation of an interior of the respective electrode.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A wire-tethered electrode for launching from a weapon, for impacting clothing of a human target, and for conducting a stimulus signal through the target to inhibit locomotion by the target, the electrode comprising:

a. a spear comprising a barb that lodges in the clothing;

b. a wire;

c. a body; wherein d. the body confines the wire against the spear to provide mechanical coupling between the body and the wire and to provide electrical coupling between the wire and the spear; and e. the stimulus signal, of the weapon and conducted by the wire, ionizes air between the barb and tissue of the target to facilitate conducting the stimulus signal through the spear and through the target.

2. A wire-tethered electrode for launching from a weapon, for impacting clothing of a human target, and for conducting a stimulus signal through the target to inhibit locomotion by the target, the electrode comprising:

a. a spear comprising a barb that lodges in the clothing;

b. an insulated wire;

c. a body; wherein d. the body confines the wire against the spear so that the stimulus signal, of the weapon and conducted by the wire, ionizes air in a gap between an uninsulated end of the wire and the spear, and ionizes air between the barb and tissue of the target to facilitate conducting the stimulus signal through the spear and through the target.

3. The electrode of claim 2 wherein the body confines the wire against the spear to further provide mechanical coupling between the wire and the body.

4. The electrode of claim 2 wherein the body confines the wire against the spear to further provide mechanical coupling between the spear and the body.

5. A wire-tethered electrode for launching from a weapon, for impacting clothing of a human target, and for conducting a stimulus signal through the target to inhibit locomotion by the target, the electrode comprising:

a. a spear comprising a barb that lodges in the clothing;

b. an insulated wire;

c. a body; wherein d. the spear confines the wire against the body so that the stimulus signal, of the weapon and conducted by the wire, ionizes air in a gap between an uninsulated end of the wire and the body, the body conducts the stimulus signal to the spear, and the stimulus signal ionizes air between the barb and tissue of the target to facilitate conducting the stimulus signal through the spear and through the target.

6. The electrode of claim 5 wherein the body confines the wire against the spear to further provide mechanical coupling between the wire and the body.

7. The electrode of claim 5 wherein the body confines the wire against the spear to further provide mechanical coupling between the spear and the body.

* * * * *